US007583240B2

(12) United States Patent
Yamashita et al.

(10) Patent No.: US 7,583,240 B2
(45) Date of Patent: Sep. 1, 2009

(54) METHOD OF DRIVING PLASMA DISPLAY PANEL

(75) Inventors: Takeru Yamashita, Osaka (JP); Hidehiko Shoji, Osaka (JP); Jumpei Hashiguchi, Kyoto (JP)

(73) Assignee: Panasonic Corporation, Osaka (JP)

( * ) Notice: Subject to any disclaimer, the term of this patent is extended or adjusted under 35 U.S.C. 154(b) by 940 days.

(21) Appl. No.: 10/546,640

(22) PCT Filed: Jan. 26, 2005

(86) PCT No.: PCT/JP2005/001436

§ 371 (c)(1),
(2), (4) Date: Aug. 24, 2005

(87) PCT Pub. No.: WO2005/073946

PCT Pub. Date: Aug. 11, 2005

(65) Prior Publication Data

US 2006/0152446 A1 Jul. 13, 2006

(30) Foreign Application Priority Data

Jan. 28, 2004 (JP) ..... 2004-019617
Feb. 6, 2004 (JP) ..... 2004-030348

(51) Int. Cl.
*G09G 3/28* (2006.01)

(52) U.S. Cl. ..... 345/60; 345/63; 345/67; 315/169.1

(58) Field of Classification Search ..... 345/60–68; 315/169.1–169.4
See application file for complete search history.

(56) References Cited

U.S. PATENT DOCUMENTS

| | | | | |
|---|---|---|---|---|
| 5,854,540 | A | 12/1998 | Matsumoto et al. | |
| 6,670,774 | B2 * | 12/2003 | Son et al. | 315/169.4 |
| 6,680,716 | B2 | 1/2004 | Nakamura | |
| 6,972,740 | B2 * | 12/2005 | Lee et al. | 345/60 |
| 7,053,559 | B2 * | 5/2006 | Kim et al. | 315/169.3 |
| 7,068,245 | B2 * | 6/2006 | Nagao et al. | 345/60 |
| 7,079,088 | B2 * | 7/2006 | Koo et al. | 345/60 |
| 7,286,103 | B2 * | 10/2007 | Kang et al. | 345/68 |
| 2002/0080098 | A1 * | 6/2002 | Kim | 345/60 |

(Continued)

FOREIGN PATENT DOCUMENTS

JP 8-129357 5/1996

(Continued)

*Primary Examiner*—Richard Hjerpe
*Assistant Examiner*—Kimnhung Nguyen
(74) *Attorney, Agent, or Firm*—Wenderoth, Lind & Ponack, L.L.P.

(57) ABSTRACT

In a method of driving a panel, in initializing periods of a plurality of sub-fields constituting one field, one of all-cell initializing operation or selective initializing operation is performed. In the all-cell initializing operation, initializing discharge is performed in all the discharge cells for displaying an image. In the selective initializing operation, initializing discharge is selectively performed only in the discharge cells subjected to sustaining discharge in the sub-field immediately before the sub-filed. According to the average picture level (APL) of the signal of an image to be displayed or the light-emitting rate of a predetermined sub-field, the initializing operation in the initializing period of each sub-field is determined to be one of the all-cell initializing operation and the selective initializing operation.

10 Claims, 7 Drawing Sheets

U.S. PATENT DOCUMENTS

| | | | | |
|---|---|---|---|---|
| 2003/0098822 | A1* | 5/2003 | Park et al. | 345/60 |
| 2003/0122739 | A1* | 7/2003 | Araki | 345/60 |
| 2004/0095295 | A1* | 5/2004 | Nagao et al. | 345/60 |

FOREIGN PATENT DOCUMENTS

| | | |
|---|---|---|
| JP | 8-221036 | 8/1996 |
| JP | 10-3281 | 1/1998 |
| JP | 10-319900 | 12/1998 |
| JP | 01-255847 | 9/2001 |
| JP | 2003-76320 | 3/2003 |

* cited by examiner

METHOD OF DRIVING PLASMA DISPLAY PANEL

THIS APPLICATION IS A U.S. NATIONAL PHASE APPLICATION OF PCT INTERNATIONAL APPLICATION PCT/JP2005/001436.

TECHNICAL FIELD

The present invention relates to a method of driving a plasma display panel.

BACKGROUND ART

An alternating current surface-discharging panel representing a plasma display panel (hereinafter abbreviated as a panel) has a plurality of discharge cells that are formed between a front panel and rear panel facing with each other. In the front panel, a plurality of display electrodes, each formed of a pair of scan electrode and sustain electrode, are formed on a front glass substrate in parallel with each other. A dielectric layer and a protective layer are formed to cover these display electrodes. On the other hand, in the rear panel, a plurality of data electrodes is formed in parallel with each other on a rear glass substrate. A dielectric layer is formed on the data electrodes to cover them. Further, a plurality of barrier ribs are formed on the dielectric layer in parallel with the data electrodes. Phosphor layers are formed on the surface of the dielectric layer and the side faces of the barrier ribs. Then, the front panel and the rear panel are faced with each other and hermetically sealed together so that the display electrodes and data electrodes intersect with each other and a discharge gas is filled into an internal discharge space formed therebetween. A discharge cell is formed at a part where a display electrode is faced with a corresponding data electrode. In a panel structured as above, ultraviolet light is generated by gas discharge in each discharge cell. This ultraviolet light excites respective phosphors to emit R, G, or B color, for color display.

A general method of driving a panel is a so-called sub-field method: one field period is divided into a plurality of sub-fields and combination of light-emitting sub-fields provides gradation images for display. Among such sub-field methods, a novel driving method of minimizing light emission unrelated to gradation representation to improve a contrast ratio is disclosed in Japanese Patent Unexamined Publication No. 2000-242224.

FIG. 8 shows an example of driving waveforms of the conventional plasma display disclosed in the above publication. These driving waveforms are described hereinafter. One filed period is composed of n sub-fields, each having an initializing period, writing period, and sustaining period. The sub-fields are abbreviated as a first SF, second SF, and so on to an n-th SF. As described below, in sub-fields except the first SF among these n sub-fields, initializing operation is performed only on discharge cells that have been lit during the sustaining period of the previous sub-field.

In the former half of the initializing period of the first SF, application of a gradually-increasing ramp voltage to scan electrodes causes weak discharge so that wall electric charge necessary for writing operation is formed on each electrode. At this time, in order to optimize the wall electric charge afterwards, excessive wall electric charge is formed. In the following latter half of the initializing period, application of a gradually-decreasing ramp voltage to the scan electrodes causes weak discharge again, to weaken the wall electric charge excessively stored on each electrode and adjust the wall electric charge to a value appropriate for each discharge cell.

In the writing period of the first SF, writing discharge is caused in discharge cells to be lit. In the sustaining period of the first SF, sustain pulses are applied to scan electrodes and sustain electrodes to cause sustaining discharge in the discharge cells in which writing discharge has occurred. Thus, the phosphors of the corresponding discharge cells emit light for image display.

In the following initializing period of the second SF, the same driving waveforms as the latter half of the initializing period of the first SF, i.e. a gradually-decreasing ramp voltage, is applied to the scan electrodes. This is because the wall charge necessary for writing operation is provided at the time of sustaining charge and thus the former half of the initializing period need not be provided independently. Therefore, weak discharge occurs in the discharge cells in which sustaining discharge has occurred in the first SF, to weaken the wall discharge excessively stored on each electrode and adjust the wall discharge to a value appropriate for each discharge cell. In discharge cells in which no sustaining discharge has occurred, the wall charge at the time of completion of the initializing period of the first SF is maintained. Thus, discharge does not occur.

As described above, the initializing operation in the first SF is all-cell initializing operation in which all the cells are discharged. The initializing operation in the second SF or after is selective initializing operation in which only discharge cells subjected to sustaining discharge are initialized. For this reason, light emission unrelated to display is weak discharge occurring in the initializing operation of the first SF only. Thus, images with a high contrast can be displayed.

With recent higher definition of a panel, the number of discharge cells is increasing and the period of time used for writing operation of one discharge cell is reducing. In addition, to improve image display quality, such as improvement of dynamic false contour, writing operation at higher speeds, such as discussion on a driving method for increasing the number of sub-fields, is required.

Now, the all-cell initializing operation for initializing all the discharge cells serves to form wall discharge necessary for writing operation, as described above. The all-cell initializing operation also serves to generate priming (priming=excited particles) to reduce discharge delay and stabilize writing discharge. Therefore, for stable high-speed writing operation, a method of increasing priming is effective. However, simply increasing the number of the all-cell initializing operations increases black picture level and decreases contrast, thus deteriorating image display quality.

The method of driving a plasma display panel of the present invention addresses the above problem, and aims to provide a method of driving a plasma display panel that enables stable high-speed writing operation and inhibits an increase in black picture level.

SUMMARY OF THE INVENTION

A method of driving a plasma display panel of the present invention, the plasma display panel including discharge cells, each formed at an intersection of a scan electrode and a sustain electrode, and a data electrode, the method comprising: dividing one field period into a plurality of sub-fields, each having an initializing period, writing period, and sustaining period; in the initializing periods of the plurality of sub-fields, performing one of all-cell initializing operation and selective initializing operation, wherein, in the all-cell initializing operation, initializing discharge is performed in all the discharge cells for displaying an image, and, in the selective initializing operation, initializing discharge is selectively performed only in the discharge cells subjected to sustaining discharge in the sub-field immediately before the sub-filed; and, according to a signal of an image to be displayed, determining the initializing operation in the initializing period of each sub-field to be one of the all-cell initializing operation and the selective initializing operation.

DETAILED DESCRIPTION OF PREFERRED EMBODIMENTS

Methods of driving a panel in accordance with exemplary embodiments of the present invention are described hereinafter with reference to the accompanying drawings.

FIRST EXEMPLARY EMBODIMENT

Figure 1:
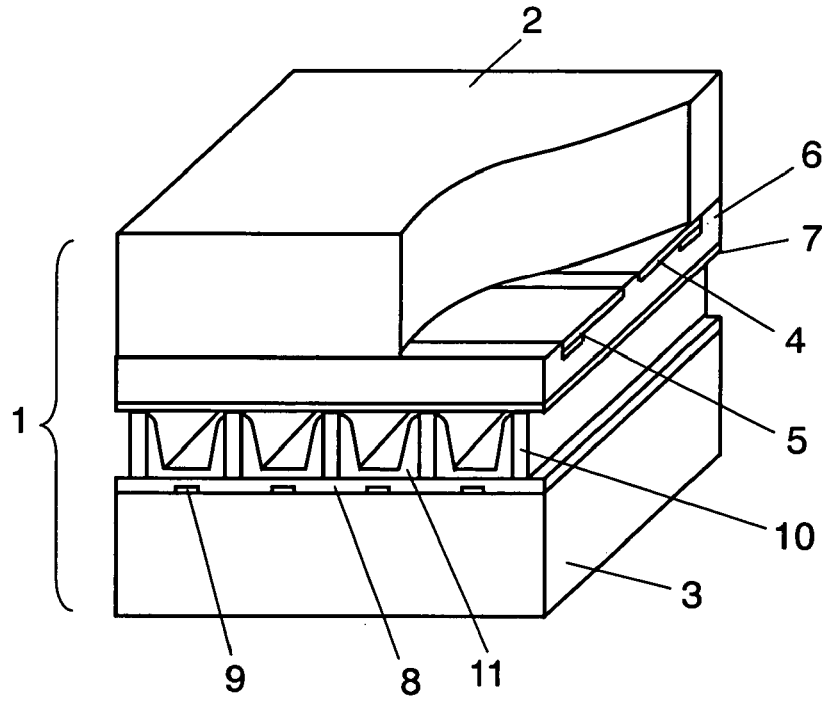
FIG. 1 is a perspective view illustrating an essential part of a panel for use in a first exemplary embodiment of the present invention.

FIG. 1 is a perspective view illustrating an essential part of a panel for use in the first exemplary embodiment of the present invention. Panel 1 is composed of front substrate 2 and rear substrate 3 that are made of glass and faced with each other so as to form a discharge space therebetween. On front substrate 2, a plurality of display electrodes, each formed of a pair of scan electrode 4 and sustain electrode 5, is formed in parallel with each other. Dielectric layer 6 is formed to cover scan electrodes 4 and sustain electrodes 5. On dielectric layer 6, protective layer 7 is formed. On the other hand, on rear substrate 3, a plurality of data electrodes 9 covered with insulating layer 8 is provided. Barrier ribs 10 are provided on insulating layer 8 between data electrodes 9 in parallel therewith. Also, phosphor layers 11 are provided on the surface of insulating layer 8 and the side faces of barrier ribs 10. Front substrate 2 and rear substrate 3 are faced with each other in a direction in which scan electrodes 4 and sustain electrodes 5 intersect with data electrodes 9. In a discharge space formed therebetween, a mix gas, e.g. neon-xenon, is filled as a discharge gas.

Figure 2:
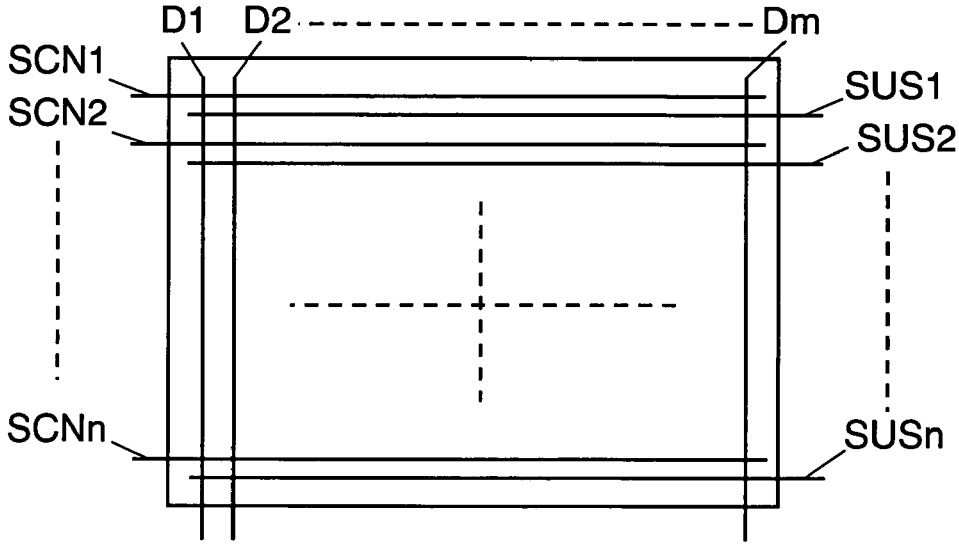
FIG. 2 is a diagram illustrating an array of electrodes of the panel.

FIG. 2 is a diagram showing an array of electrodes of the panel for use in the first exemplary embodiment of the present invention. N scan electrodes SCN 1 to SCNn (scan electrodes 4 in FIG. 1) and n sustain electrodes SUS 1 to SUSn (sustain electrodes 5 in FIG. 1) are alternately disposed in a row direction. M data electrodes D1 to Dm (data electrodes 9 in FIG. 1) are disposed in a column direction. A discharge cell is formed at a portion in which a pair of scan electrode SCNi and sustain electrode SUSi (i=1 to n) intersect with one data electrode Dj (j=1 to m). Thus, m×n discharge cells are formed in the discharge space.

Figure 3:
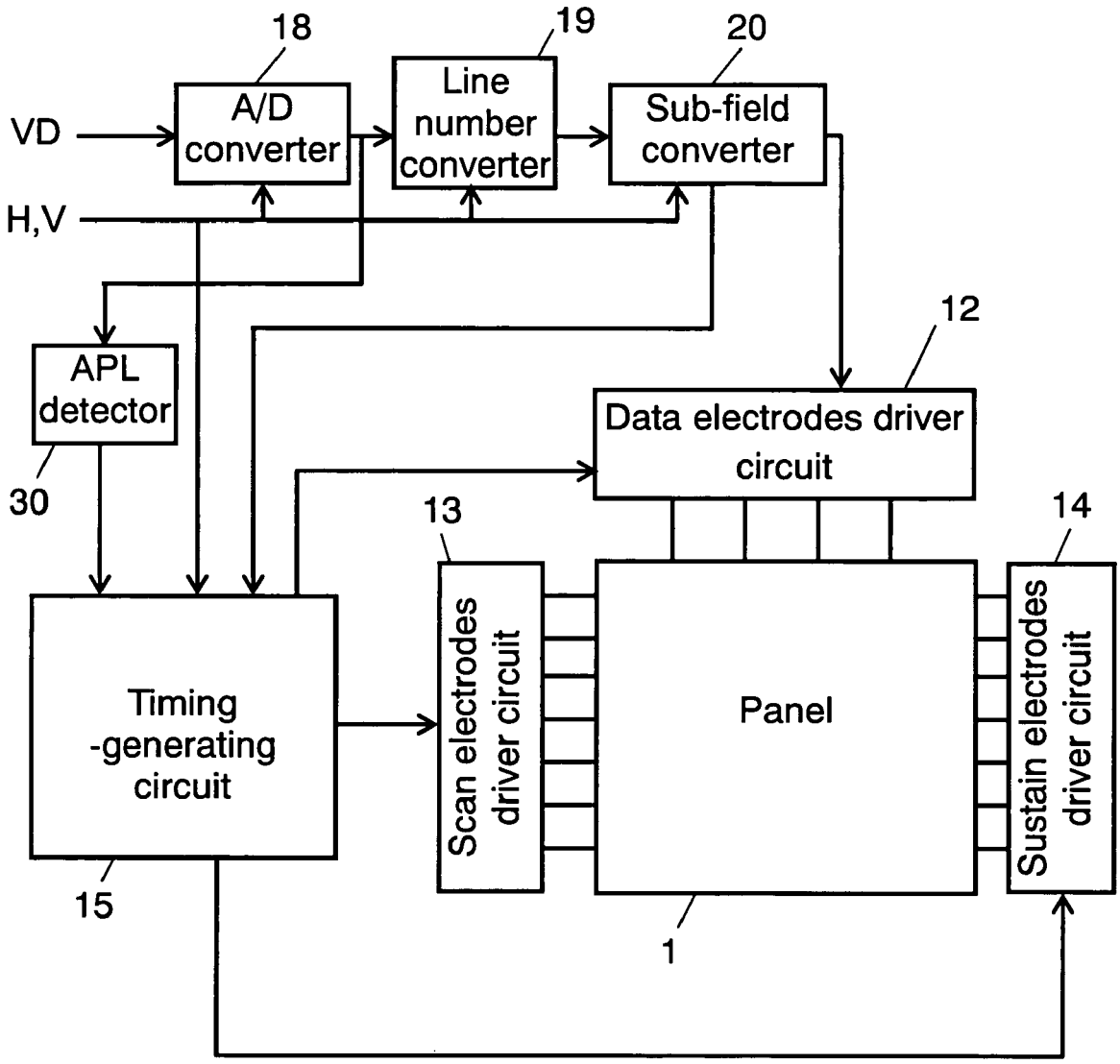
FIG. 3 is a circuit block diagram of a plasma display device for use in the method of driving a panel.

FIG. 3 is a circuit diagram of a plasma display device for use in the method of driving a panel in accordance with the first exemplary embodiment. The plasma display panel device includes panel 1, data electrodes driver circuit 12, scan electrodes driver circuit 13, sustain electrodes driver circuit 14, timing-generating circuit 15, analog-to-digital (A/D) converter 18, line number converter 19, and sub-field converter 20, average picture level (APL) detector 30, and power supply circuits (not shown).

With reference to FIG. 3, image signal VD is fed into A/D converter 18. Horizontal synchronizing signal H and vertical synchronizing signal V are fed into timing-generating circuit 15, A/D converter, line number converter 19, and sub-field converter 20. A/D converter 18 converts image signal VD into image data of digital signals, and feeds the digital image data into line number converter 19 and APL detector 30. APL detector 30 detects an average picture level of the image data. Line number converter 19 converts the image data into image data corresponding to the number of pixels of panel 1, and feeds the image data to sub-field converter 20. Sub-field converter 20 divides the image data of respective pixels into a plurality of bits corresponding to a plurality of sub-fields. The image data per sub-field is fed into data electrodes driver circuit 12. Data electrodes driver circuit 12 converts the image data per sub-field into signals corresponding to respective data electrodes D1 to Dm, and drives respective data electrodes D1 to Dm.

Timing-generating circuit 15 generates timing signals based on horizontal synchronizing signal H and vertical synchronizing signal V, and feeds the timing signals to scan electrodes driver circuit 13 and sustain electrodes driver circuit 14, respectively. Responsive to the timing signals, scan electrodes driver circuit 13 feeds driving waveforms to scan electrodes SCN1 to SCNn. Responsive to the timing signals, sustain electrodes driver circuit 14 feeds driving waveforms to sustain electrodes SUS1 to SUSn. At this time, timing-generating circuit 15 controls the driving waveforms, according to an APL supplied from APL detector 30. Specifically, as described later, according to the APL, timing-generating circuit 15 determines to perform one of all-cell initializing operation and selective initializing operation in each of the sub-fields comprising one field and, controls the number of the all-cell initializing operations in one field.

Figure 4:
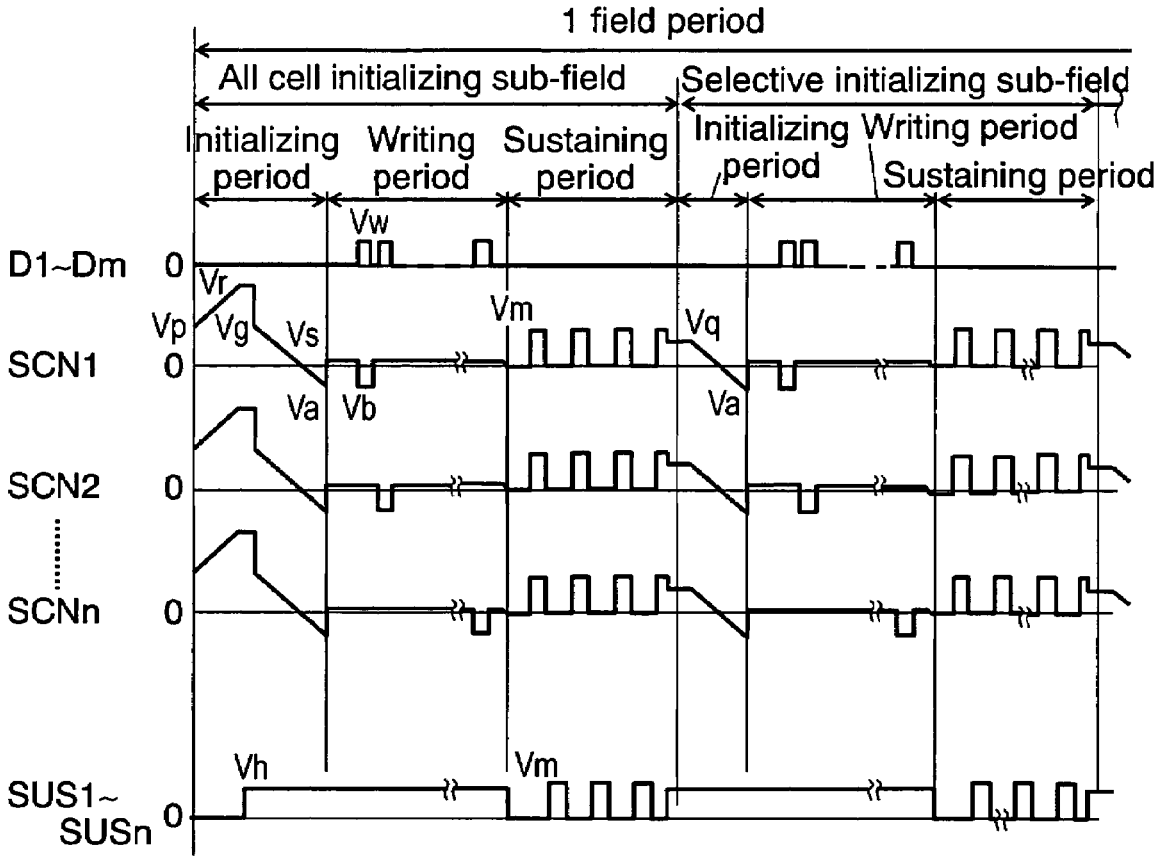
FIG. 4 is a diagram showing driving waveforms applied to respective electrodes of the panel.

Next, driving waveforms for driving the panel and their operation are described. FIG. 4 is a diagram showing driving waveforms applied to respective electrodes of the panel in accordance with the first exemplary embodiment of the present invention The diagram shows waveforms of a sub-field having an initializing period in which all-cell initializing operation is performed (hereinafter abbreviated as "all-cell initializing sub-field") and a sub-field having an initializing period in which selective initializing operation is performed (hereinafter abbreviated as "selective initializing sub-field"). In FIG. 4, for simple description, the first sub-field is shown as an all-cell initializing sub-field, and the second sub-field is shown as a selective initializing sub-field.

First, the driving waveforms and operation of the all-cell initializing sub-field are described.

In the initializing period, while data electrodes D1 to Dm and sustain electrodes SUS1 to SUSn are kept at 0V, a ramp voltage gradually increasing from voltage Vp (V) not higher than a discharge-starting voltage to voltage Vr (V) exceeding the discharge-starting voltage is applied to scan electrodes SCN1 to SCNn. This causes a first weak initializing discharge in all the discharge cells. Thus, negative wall voltage accumulates on scan electrodes SCN1 to SCNn and positive wall voltage accumulates on sustain electrodes SUS1 to SUSn and data electrodes D1 to Dm. Now, the wall voltage on electrodes indicates a voltage generated by wall electric charge that has accumulated on the dielectric layers or phosphor layers covering the electrodes. Thereafter, sustain electrodes SUS1 to SUSn are kept at positive voltage Vh (V), and a ramp voltage gradually decreasing from voltage Vg (V) to voltage Va(V) is applied to scan electrodes SCN1 to SCNn. This causes a second weak initializing discharge in all the discharge cells. The wall voltage on scan electrodes SCN1 to SCNn and the wall voltage on sustain electrodes SUS1 to SUSn are weakened, and the wall voltage on data electrodes D1 to Dm are adjusted to a value appropriate for writing operation. In this manner, the initializing operation in the all-cell initializing sub-field is all-cell initializing operation in which initializing discharge is performed in all the discharge cells.

In the subsequent writing period, scan electrodes SCN1 to SCNn are held at voltage Vs (V) once. Next, positive write pulse voltage Vw (V) is applied to data electrode Dk of discharge cells to be lit in the first row among data electrodes D1 to Dm, and scan pulse voltage Vb (V) is applied to scan electrode SCN1 in the first row. At this time, the voltage at the intersection between data electrode Dk and scan electrode SCN1 is addition of the wall voltage on data electrode Dk and the wall voltage on scan electrode SCN1 to externally applied voltage (Vw-Vb) (V), thus exceeding the discharge-starting voltage. This causes writing discharge between data electrode Dk and scan electrode SCN1, and between sustain electrode SUS1 and scan electrode SCN1. Thus, positive wall voltage accumulates on scan electrode SCN1, negative wall voltage accumulates on sustain electrode SUS1, and negative wall voltage also accumulates on data electrode Dk in this discharge cell. Thus, writing operation is performed in the discharge cells to be lit in the first row to accumulate wall voltage on respective electrodes. On the other hand, the intersection of a data electrode to which positive write pulse voltage Vw (V) is not applied, and scan electrode SCN1 does not exceed the discharge-starting voltage. Thus, no writing discharge occurs in this intersection. Such writing operation is sequentially performed on the cells in the second row to the n-th row, and the writing period is completed.

In the subsequent sustaining period, first, sustain electrodes SUS1 to SUSn are reset to 0V, and positive sustain pulse voltage Vm (V) is applied to scan electrodes SCN1 to SCNn. At this time, in the discharge cells in which writing discharge has occurred, the voltage across scan electrode SCNi and sustain electrode SUSi amounts to addition of the wall voltage on scan electrode SCNi and the wall voltage on sustain electrode SUSi to sustain pulse voltage Vm (V), thus exceeding the discharge-starting voltage. This causes sustaining discharge between scan electrode SCNi and sustain electrode SUSi. Thus, negative wall voltage accumulates on scan electrode SCNi, and positive wall voltage accumulates on sustain electrode SUSi. At this time, positive wall voltage also accumulates on data electrode Dk. Incidentally, in the discharge cells in which no writing discharge has occurred in the writing period, no sustaining discharge occurs, and the state of the wall voltage at the time of completion of the initializing period is maintained. Sequentially, scan electrodes SCN1 to SCNn are reset to 0V, and positive sustain pulse voltage Vm (V) is applied to sustain electrodes SUS1 to SUSn. In the discharge cells in which sustaining discharge has occurred, the voltage across sustain electrode SUSi and scan electrode SCNi exceeds the discharge-starting voltage. This causes sustaining discharge between sustain electrode SUSi and scan electrode SCNi again. Thus, negative wall voltage accumulates on sustain electrode SUSi, and positive wall voltage accumulates on scan electrode SCNi. Applying sustain pulse alternately across scan electrodes SCN1 to SCNn and sustain electrodes SUS1 to SUSn in a similar manner can continue sustaining discharge in the discharge cells in which writing discharge has occurred in the writing period. Incidentally, at the end of the sustaining period, the wall voltage on sustain electrodes SCN1 to SCNn and sustain electrodes SUS1 to SUSn are erased by applying a so-called thin pulse across scan electrodes SCN1 to SCNn and sustain electrodes SUS1 to SUSn while leaving the positive wall voltage on data Dk. Thus, the sustaining operation in the sustaining period is completed.

Next, the driving waveforms of the selective sub-field and their operation are described.

In the initializing period, sustain electrodes SUS1 to SUSn are kept at voltage Vh (V), data electrodes D1 to Dm are kept at 0V, and a ramp voltage gradually decreasing from voltage Vq (V) to voltage Va(V) is applied to scan electrodes SCN1 to SCNn. This causes weak initializing discharge in the discharge cells in which sustaining discharge has occurred in the sustaining period of the previous sub-field. The wall voltage on scan electrode SCNi and the wall voltage on sustain electrode SUSi are weakened, and the wall voltage on data electrode Dk is adjusted to a value appropriate for writing operation. On the other hand, in the discharge cells in which writing discharge or sustaining discharge has not occurred in the previous sub-field, no discharge occurs and the state of the wall charge at the time of completion of the initializing period of the previous sub-field is maintained. In this manner, in the initializing period of the selective initializing sub-field is selective initializing operation in which initializing discharge occurs in the discharge cells subjected to sustaining discharge in the previous sub-field.

The writing period and sustaining period are the same as those of the all-cell initializing sub-field. Thus, the description is omitted.

Next, a description is provided of a structure of the sub-fields in the method of driving a panel of this embodiment. In this embodiment, one field is composed of 11 sub-fields. In the description, respective sub-fields have a brightness weight of 1, 2, 3, 7, 11, 14, 23, 37, 39, 57, or 61. However, the number of sub-fields or the brightness weight of each sub-field is not limited to the above values.

Figure 5:
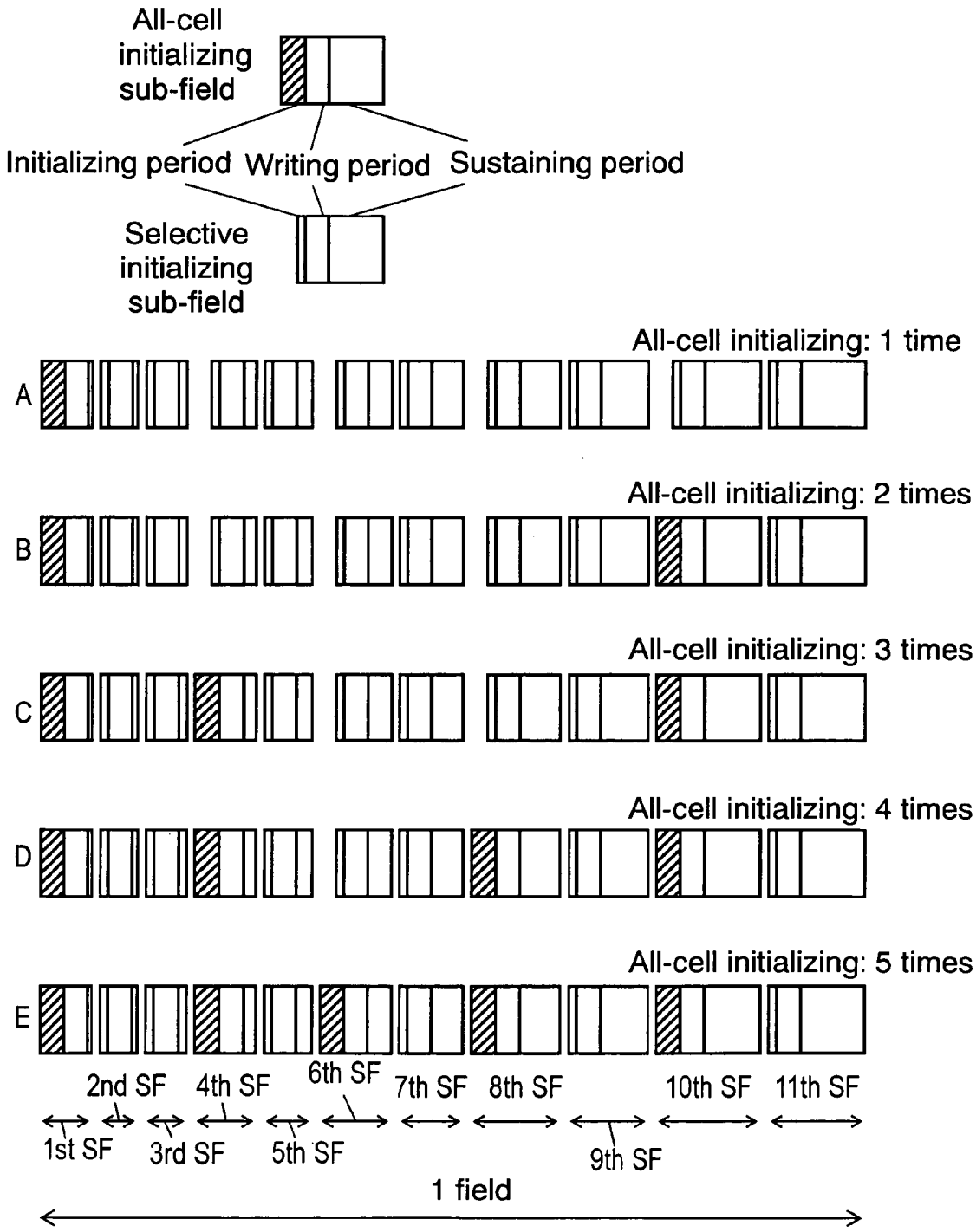
FIG. 5 is a diagram illustrating a structure of sub-fields in the method of driving a panel.

FIG. 5 is a diagram illustrating a structure of each sub-field (SF) in the method of driving a panel of the first exemplary embodiment. The sub-field structure is changed according to the APL of the signal of an image to be displayed. FIG. 5A shows a structure to be used for an image signal having an APL ranging from 0 to 1.5%. In this SF structure, all-cell initializing operation is performed only in the initializing period of the first SF, and selective initializing operation is performed in the initializing periods of the second to 11th SFs. FIG. 5B shows a structure to be used for an image signal having an APL ranging from 1.5 to 5%. In this SF structure, all-cell initializing operation is performed in the initializing periods of the first and 10th SFs, and selective initializing operation is performed in the initializing periods of the second to ninth, and 11th SFs. FIG. 5C shows a structure to be used for an image signal having an APL ranging from 5 to 10%. In this SF structure, all-cell initializing operation is performed in the initializing periods of the first, fourth and 10th SFs, and selective initializing operation is performed in the second, third, fifth to ninth, and 11th SFs. FIG. 5D shows a structure to be used for an image signal having an APL ranging from 10 to 15%. In this SF structure, all-cell initializing operations is performed in the initializing periods of the first, fourth, eighth and 10th SFs, and selective initializing operation is performed in the initializing periods of the second, third, fifth to seventh, ninth and 11th SFs. FIG. 5E shows a structure to be used for an image signal having an APL ranging from 15 to 100%. In this SF structure, all-cell initializing operation is performed in the initializing periods of the first, fourth, sixth, eighth and 10th SFs, and selective initializing operation is performed in the initializing periods of the second, third, fifth, seventh, ninth and 11th SFs. Table 1 shows a relation between the above SF structure and APL.

TABLE 1

| APL (%) | Number of all-cell initializing operations (times) | All-cell initializing SFs |
|---|---|---|
| 0 to 1.5 | 1 | 1 |
| 1.5 to 5 | 2 | 1, 10 |
| 5 to 10 | 3 | 1,4, 10 |
| 10 to 15 | 4 | 1,4, 8,10 |
| 15 to 100 | 5 | 1,4,6, 8,10 |

In this manner, in the method of driving a panel of the first exemplary embodiment, the structure of SFs is controlled so that the number of all-cell initializing operations is reduced at a lower APL. Although the number of all-cell initializing operations per field is determined depending on the APL, many forms can be considered for the determination of the position of the sub-fields in which all-cell initializing operation is performed. However, in consideration of the effect of the all-cell initializing operation, i.e. formation of wall voltage for writing operation and generation of priming, it is desirable to distribute the SFs having all-cell initializing periods. It is especially desirable that these SFs are not disposed successively. The reason why the all-cell initializing period is placed not in the 11th SF but in the 10th SF in Table 1 is to avoid successive placement of the all-cell initializing periods, i.e. the 11th SF and the first SF.

Additionally, in the first exemplary embodiment, the SFs having initializing periods subjected to all-cell initializing operation are preferentially placed at the former part or latter part of one field period rather than the middle part of one field. In other words, when the number of all-cell initializing operations are sequentially reduced from 5 to 1, the all-cell initializing SF is eliminated from the 6th SF in the middle part first, and then sequentially eliminated from the 8th, 4th, and 10th in order. The all-cell initializing periods should be eliminated from those least affecting the image display quality. This depends on the brightness weights of respective SFs or coding methods (how to assign sub-fields having brightness weights to respective gradation levels). Experiments have validated that elimination of all-cell initializing periods in the middle part of one field less affects the image quality when the weighting is made in an increasing order and the employed coding method is to express brightness using sub-fields in time order, like the first exemplary embodiment. Further, the all-cell initializing operation in the first SF largely affects the image display quality. This is because writing operation should securely be performed from the top SF, and priming for this writing operation is important when a dark image is displayed. The all-cell initializing operation in the SFs in the latter part is also important. This is because it is considered that excessive priming neutralizes the wall discharge on unlit discharge cells and thus destabilizes the writing operation in the following SFs when the discharge cells adjacent to the unlit cell light in a sub-filed having a large brightness weight.

As described above, in the first exemplary embodiment, because it is considered that there is no or a small area displaying a black picture when an image having a large APL is displayed, the number of all-cell initializing operations and thus priming are increased to stabilize discharge. In contrast, when an image having a low APL is displayed, it is considered that there is a large area displaying a black picture. Thus, the number of all-cell initializing operations is reduced to improve black display quality. Therefore, at a low APL, luminance in an area displaying black picture is low, and an image having high contrast can be displayed even when the image has areas having high luminance.

In the first exemplary embodiment, one field is composed of 11 SFs and the number of all-cell initializing operations is controlled to one to five times, as an example. However, the present invention is not limited to this example. Tables 2 and 3 show another example.

TABLE 2

| APL (%) | Number of all-cell initializing operations (times) | All-cell initializing SFs |
|---|---|---|
| 0.0 to 1.5 | 1 | 1 |
| 1.5 to 5 | 2 | 1, 9 |
| 5 to 10 | 3 | 1,4, 9 |
| 10 to 100 | 4 | 1,4, 8, 10 |

TABLE 3

| APL (%) | Number of all-cell initializing operations (times) | All-cell initializing SFs |
|---|---|---|
| 0.0 to 1.5 | 1 | 1 |
| 1.5 to 5 | 2 | 1,4 |
| 5 to 100 | 3 | 1,4,6 |

In Table 2, the number of all-cell initializing operations is controlled to one to four times, and the SFs in which all-cell initializing operation is performed are changed, as an example. In Table 3, the number of all-cell initializing operations is controlled to one to three times, and the SFs near the top part are initialized preferentially, as an example.

As described above, at a low APL, reducing the number of SFs each having an initializing period subjected to all-cell initializing operation, and, at a higher APL, increasing the number of SFs each having an initializing period subjected to all-cell initializing operation can achieve a method of driving a panel that enables stable high-speed writing and inhibits an increase in black picture level.

SECOND EXEMPLARY EMBODIMENT

Figure 6:
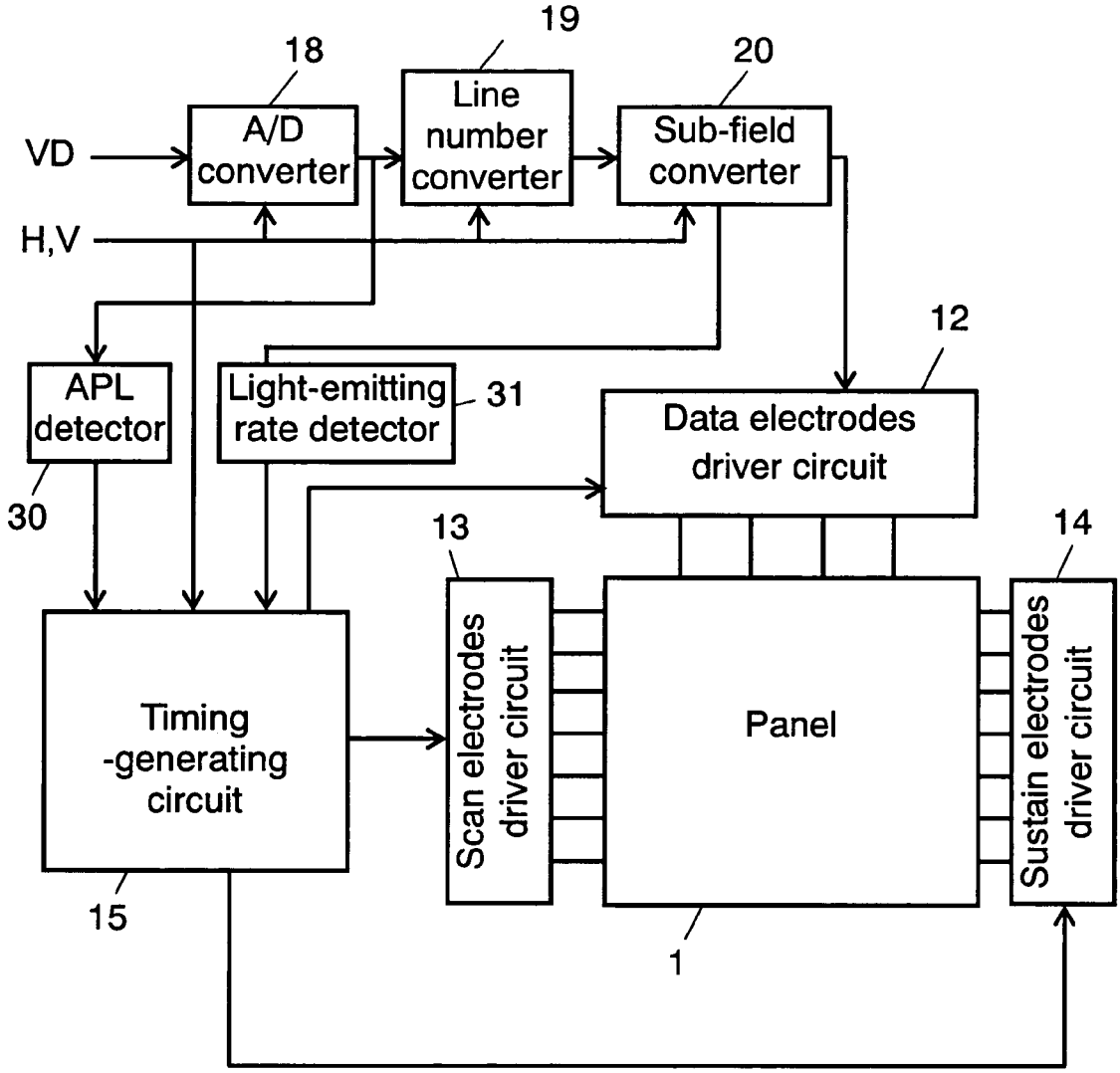
FIG. 6 is a circuit block diagram of a plasma display device for use in a method of driving a panel in accordance with a second exemplary embodiment.

The essential part of a panel and the array of electrodes for use in the second exemplary embodiment are similar to those of the first exemplary embodiment. Thus, the description thereof is omitted. FIG. 6 is a circuit block diagram of a plasma display device for use in a method of driving a panel in accordance with the second exemplary embodiment. The same elements used in the first exemplary embodiment are denoted with the same reference marks and the description thereof is omitted.

Sub-field converter 20 divides image data of each pixel into a plurality of bits corresponding to a plurality of sub-fields (SFs), and supplies the image data per SF to data electrodes driving circuit 12 and light-emitting rate detector 31. Light-emitting rate detector 31 detects a light-emitting rate of a predetermined SF, i.e. the light-emitting rate of the 10th SF in this secondary exemplary embodiment.

Timing-generating circuit 15 generates timing signals based on horizontal synchronizing signal H and horizontal synchronizing signal V, and supplies them to scan electrodes driving circuit 13 and sustain electrodes driving circuit 14. Now, timing-generating circuit 15 controls a driving waveform according to an APL supplied from APL detector 30 and a light-emitting rate supplied from light-emitting rate detector 31. Specifically, as described later, timing-generating circuit 15 determines the initializing operation in respective SFs constituting one field to be all-cell initializing or selective initializing, and controls the positions and number of all-cell initializing operations in one field.

Figure 7:
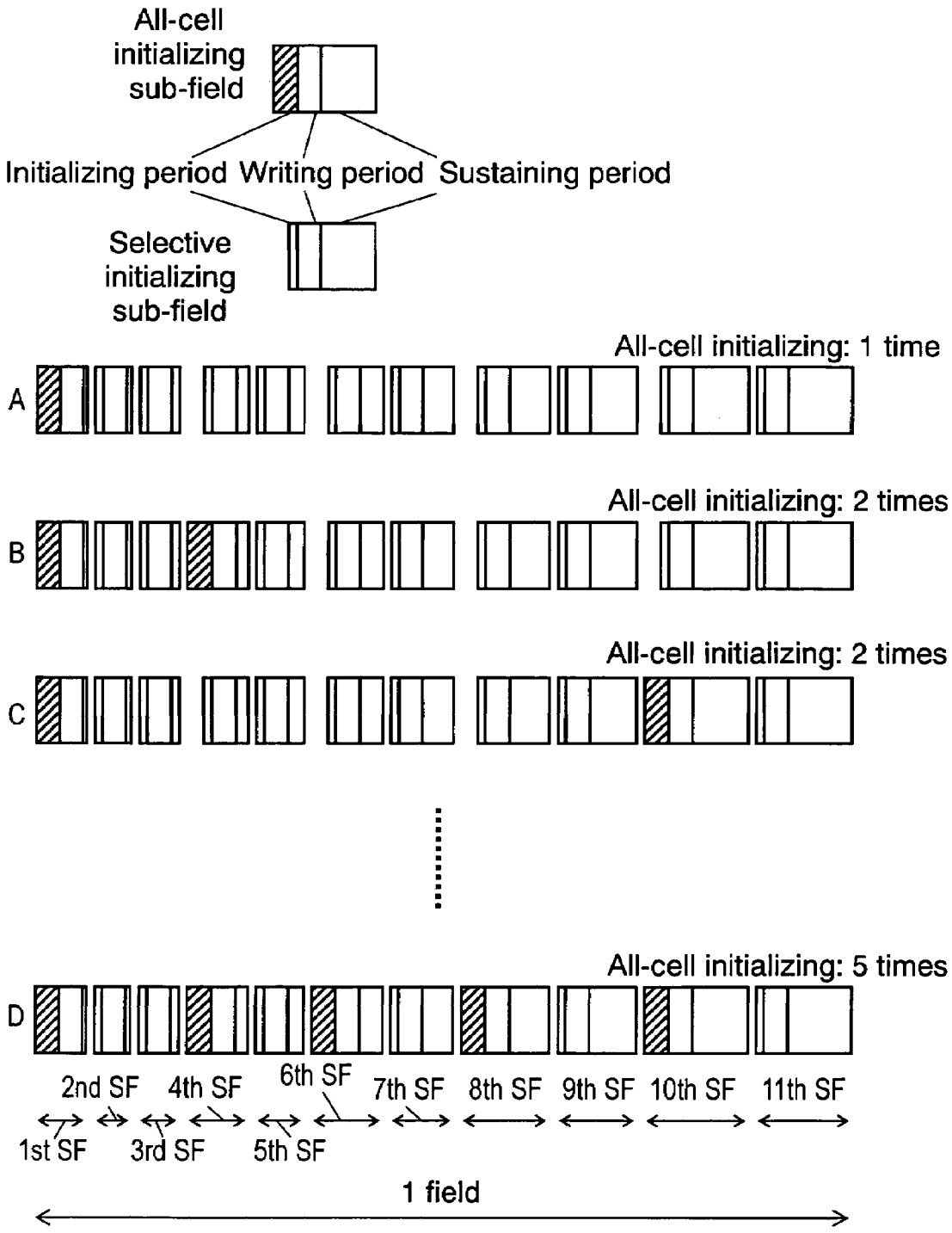
FIG. 7 is a diagram illustrating a structure of sub-fields in the method of driving a panel.
Figure 8:
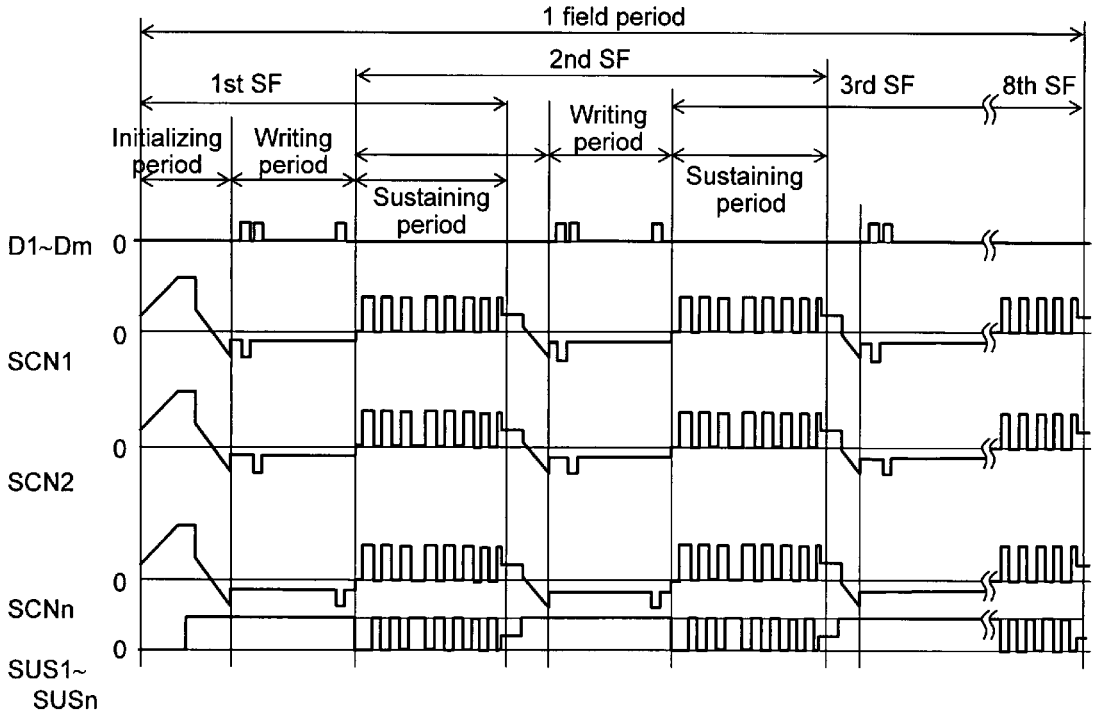
FIG. 8 PRIOR ART
FIG. 8 is a diagram showing driving waveforms of a conventional panel.

FIG. 7 is a diagram illustrating a structure of SFs in the method of driving a panel in accordance with the second exemplary embodiment. The SF structure is changed according to an APL of an image to be displayed and a light-emitting rate of the 10th SF. FIG. 7A shows a structure to be used for an image signal having an APL ranging from 0 to 1.5%. In this SF structure, all-cell initializing operation is performed in the initializing period of the first SF only, irrelevant to the light-emitting rate of the 10th SF, and selective initializing operation is performed in the initializing periods of the second to 11th SFs. 7B shows a structure to be used for an image signal having an APL ranging from 1.5 to 5%, and a light-emitting rate ranging from 0 to 1%. In this SF structure, all-cell initializing operation is performed in the initializing periods of the first and fourth SFs, and the selective initializing operation is performed in the initializing periods of the second, third, and fifth to 11th SFs. 7C shows a structure to be used for an image signal having an APL ranging from 1.5 to 5% and a light-emitting rate of at least 1%. In this SF structure, all-cell initializing operation is performed in the initializing periods of the first and 10th SFs, and selective initializing operation is performed in the initializing periods of the second to ninth, and 11th SFs. 7D shows a structure to be used for an image signal having an APL ranging from 15 to 100%. In this SF structure, all-cell initializing operation is performed in the initializing periods of the first, fourth, sixth, eighth, and 10th SFs, and selective initializing operation is performed in the initializing periods of the second, third, fifth, seventh, ninth, and 11th SFs, irrelevant to the light-emitting rate of the 10th SF. The structure used for an image signal having an APL ranging from 5 to 15% is not shown. Its SF structure is different from those described above. Table 4 shows a relation between a SF structure, APL, and light-emitting rate.

TABLE 4

| APL (%) | Number of all-cell initializing operations | Light-emitting rate of 10th SF 0~1 | 1~20 | 20~100 |
|---|---|---|---|---|
| 0~1.5 | 1 | 1 | | |
| 1.5~5 | 2 | 1,4 | 1, 10 | |
| 5~10 | 3 | 1,4,6 | 1,4, 10 | 1, 8,10 |
| 10~15 | 4 | 1,4,6,8 | 1,4, 8,10 | 1, 6,8,10 |
| 15~100 | 5 | 1,4,6,8,10 | | |

In this manner, the method of driving a panel of the second exemplary embodiment controls the SF structure to reduce the number of all-cell initializing operations at a lower APL. Further, even when the number of all-cell initializing operations is the same, attention is drawn to the light-emitting rate of the 10th SF. At a low light-emitting rate, all-cell initializing SFs are preferentially placed in the former part of one field period. At a high light-emitting rate, all-cell initializing SFs are preferentially placed at the latter part of one field period. However, even at a high light-emitting rate, the first SF is an all-cell initializing SF.

As described above, the number of all-cell initializing operations per field is determined depending on an APL, and the position of the SFs subjected to all-cell initializing operation is determined depending on a light-emitting rate. In consideration of the effect of the all-cell initializing operation, i.e. formation of wall voltage for writing operation and generation of priming, it is desirable to distribute the SFs having all-cell initializing periods. It is especially desirable that these SFs are not disposed successively. The reason why the all-cell initializing period is placed not in the 11th SF but in the 10th SF in Table 4 is to avoid successive placement of the all-cell initializing periods, i.e. 11th SF and the first SF. The reason why attention is drawn to a light-emitting rate of the 10th SF is that the 10th SF has the largest brightness weight in the SFs that can have all-cell initializing periods. Additionally, in the second exemplary embodiment, the SFs in which all-cell initializing operation is performed are preferentially placed in the former part or latter part of one field period rather than the middle part thereof. Then, at a low light-emitting rate of the 10th SF, all-cell initializing SFs are preferentially placed in the former part of one field period. At a high light-emitting rate of the 10th SF, all-cell initializing SFs are preferentially placed in the latter part of one field period. This is because, at a relatively low APL and a low light-emitting rate of the 10th SF, the entire screen is dark and writing operation must securely be performed from the top SF so that a dark image is displayed. Thus, priming for the writing operation is extremely important. On the other hand, at a relatively high light-emitting rate of the 10th SF, all-cell initializing operation in the SFs in the latter part is considered important. The reason is explained as follows. When sustaining discharge occurs in discharge cells adjacent to unlit discharge cells in the sustaining period, in a SF with a large brightness weight that is placed in the latter part of one field, charged particles generated by the sustaining discharge neutralize the wall charge on the unlit discharge cells, and the wall charge is insufficient for writing operation in the successive SF. The all-cell initializing operation in the SFs in the latter part can compensate this insufficient wall charge.

As described above, in the second exemplary embodiment, because it is considered that there is no or a small area displaying a black picture when an image having a large APL is displayed, the number of all-cell initializing operations and thus priming are increased to stabilize discharge. In contrast, when an image having a low APL is displayed, it is considered that there is a large area displaying a black picture, and thus the number of all-cell initializing operations is reduced to improve black display quality. Then, when an image having a low light-emitting rate in a predetermined SF (the 10th SF in the second exemplary embodiment) is displayed, all-cell initializing SFs are preferentially placed in the former part of one field period to ensure priming for writing from the top SF. In contrast, at a high light-emitting rate, all-cell initializing SFs are preferentially placed in the latter part of one field to form necessary wall charge again even if excessive priming neutralizes the wall charge on unlit discharge cells. Therefore, at a low APL, luminance in an area displaying black picture is low and an image having a high contrast ratio can be displayed even when the image has an area having high luminance. Further, placement of all-cell initializing SFs in most effective positions according to the light-emitting rate of a predetermined SF enables stable high-speed writing operation.

Also in the second exemplary embodiment, one field is composed of 11 SFs and the number of all-cell initializing operations is controlled to one to five times, as an example. However, the present invention is not limited to this example.

In the second exemplary embodiment, the 10th SF is used as a predetermined SF. However, any other field having a large brightness weight, such as the ninth or 11th, can be used. Further, a plurality of SFs having large brightness weights can be used in combination.

TABLE 5

| APL (%) | Number of all-cell initializing operations | Sum of light-emitting rates of 9th to 11th SFs: Less than 3% | Sum of light-emitting rates of 9th to 11th SFs: 3% or more |
|---|---|---|---|
| 0~1.5 | 1 | 1 | |
| 1.5~5 | 2 | 1,4 | 1, 9 |
| 5~10 | 3 | 1,4, | 9 |
| 10~100 | 4 | 1,4, | 7,9 |

In Table 5, the number of all-cell initializing operations is controlled in the range of one to four times, and only when the number of all-cell initializing operations is two, the position of the all-cell initializing SFs is changed depending on the sum of the light-emitting rates of the ninth to 11th SFs, as an example. In this manner, at a high APL, the number of SFs having initializing periods subjected to all-cell initializing operation is increased. When an image having a low light-emitting rate of a SF with a large brightness weight is displayed, all-cell initializing SFs are preferentially placed in the former part of one field period. When an image having a high light-emitting rate of a SF with large brightness weight is displayed, all-cell initializing SFs are preferentially placed in the latter part of one field period. This method can provide a method of driving a panel that enables stable high-speed writing and inhibits an increase in black picture level.

The present invention can provide a method of driving a plasma display panel that enables stable high-speed writing and inhibits an increase in black picture level.

INDUSTRIAL APPLICABILITY

The method of driving a panel of this invention can drives a panel in such a manner that enables stable high-speed writing and inhibits an increase in black picture level. The present invention is useful as a display device using a panel.

The invention claimed is:

1. A method of driving a plasma display panel, the plasma display panel including discharge cells, each formed at an intersection of a scan electrode and a sustain electrode, and a data electrode, the method comprising:

dividing one field period into a plurality of sub-fields, each having an initializing period, writing period, and sustaining period;

in the initializing periods of the plurality of sub-fields, performing one of all-cell initializing operation and selective initializing operation, wherein, in the all-cell initializing operation, initializing discharge is performed in all discharge cells for displaying an image, and, in the selective initializing operation, initializing discharge is selectively performed only in discharge cells subjected to sustaining discharge in a sub-field immediately before each of the sub-filed; and according to a signal of the image to be displayed, determining the initializing operation in the initializing period of each sub-field to be one of the all-cell initializing operation and the selective initializing operation.

2. The method of driving a plasma display panel of claim 1, wherein one of the all-cell initializing operation and the selective initializing operation is determined according to an APL of the signal of the image.

3. The method of driving a plasma display panel of claim 2, wherein, at a low APL, a number of sub-fields each having an initializing period subjected to all-cell initializing operation is reduced, and, at a high APL, a number of sub-fields each having an initializing period subjected to all-cell initializing operation is increased.

4. The method of driving a plasma display panel of claim 3, wherein, each sub-filed following the sub-fields having initializing periods subjected to all-cell initializing operation is a sub-filed having an initializing period subjected to selective initializing operation.

5. The method of driving a plasma display panel of claim 4, wherein, the sub-fields having initializing periods subjected to all-cell initializing operation is preferentially placed in one of a former part and a latter part of one field period.

6. A method of driving a plasma display panel of claim 1, wherein one of all-cell initializing operation and selective initializing operation is determined, according to a light-emitting rate of a predetermined sub-field in a signal of an image.

7. The method of driving a plasma display panel of claim 6, wherein, each sub-field following sub-fields having initializing periods subjected to all-cell initializing operation is a sub-filed having an initializing period subjected to selective initializing operation.

8. The method of driving a plasma display panel of claim 7, wherein, the sub-fields having initializing periods subjected to all-cell initializing operation are preferentially placed in one of a former part and a latter part of one field period.

9. The method of driving a plasma display panel of claim 8, wherein, when a light-emitting rate of the predetermined sub-field is low, the sub-fields having initializing periods subjected to all-cell initializing operation are preferentially placed in the former part of one field period, and when the light-emitting rate of the predetermined sub-field is high, the sub-fields having initializing periods subjected to all-cell initializing operation are preferentially placed in the latter part of one field period.

10. The method of driving a plasma display panel of claim 9, wherein, the predetermined sub-field is a sub-field having a large brightness weight.

* * * * *

UNITED STATES PATENT AND TRADEMARK OFFICE

CERTIFICATE OF CORRECTION

PATENT NO. : 7,583,240 B2
APPLICATION NO. : 10/546640
DATED : September 1, 2009
INVENTOR(S) : Takeru Yamashita et al.

It is certified that error appears in the above-identified patent and that said Letters Patent is hereby corrected as shown below:

On the Cover Page

Item (56) References Cited, under the "FOREIGN PATENT DOCUMENTS" heading, reference "JP 01-255847" should read --JP 2001-255847--.

Signed and Sealed this

Second Day of February, 2010

David J. Kappos

David J. Kappos
*Director of the United States Patent and Trademark Office*